US005867879A

United States Patent [19]

Ferraro et al.

[11] Patent Number: 5,867,879

[45] Date of Patent: Feb. 9, 1999

[54] STRETCHER IN CALENDERS FOR TUBULAR KNITTED FABRICS

[75] Inventors: Giancarlo Ferraro, Somma Lombardo; Renzo Milanese, Marano Ticino, both of Italy

[73] Assignee: Ferraro, S.p.A., Lonate Pozzolo, Italy

[21] Appl. No.: 839,465

[22] Filed: Apr. 14, 1997

Related U.S. Application Data

[63] Continuation-in-part of PCT/IT95/00178, Nov. 7, 1995.

[30] Foreign Application Priority Data

Nov. 9, 1994 [IT] Italy ..... MI94A2261

[51] Int. Cl.[6] ..... D06C 5/00

[52] U.S. Cl. ..... 26/83; 26/84

[58] Field of Search ..... 26/80, 83, 84, 26/85, 81, 72, 77

[56] References Cited

U.S. PATENT DOCUMENTS

| | | | |
|---|---|---|---|
| 2,623,263 | 12/1952 | Dungler | 26/84 |
| 3,175,272 | 3/1965 | Cohn et al. | 26/84 |
| 3,882,577 | 5/1975 | Aronoff | 26/84 |
| 4,103,402 | 8/1978 | Frezza | 26/84 |
| 4,173,812 | 11/1979 | Cecere | 26/84 |
| 4,947,529 | 8/1990 | Werner et al. | 26/84 |
| 5,594,978 | 1/1997 | Ferraro | 26/84 |

FOREIGN PATENT DOCUMENTS 0267880 5/1988 European Pat. Off. .

*Primary Examiner*—Amy Vanatta
*Attorney, Agent, or Firm*—Dann, Dorfman, Herrell and Skillman; Henry H. Skillman

[57] ABSTRACT

The invention relates to a stretcher for tubular knitted fabrics comprising two separate stretcher arms (5, 6) bearing pulleys (23) in contact with belts (22) for carrying fabric (4), driven by drive wheels (11A, 11B) borne by supports (8) suitable to horizontally move in opposite directions and bearing pairs of support rolls (19, 20) with angled axle (21), each pair (19, 20) supporting on the opposite sides a ring (17) which has a particular profile, is idle on each arm (5, 6) and is in contact with each drive wheel (11A, 11B), wherein the above mentioned pairs of rolls (19, 20) are motor-driven.

5 Claims, 2 Drawing Sheets

1
2
3
4
5
5'
6
6'
7
8
10
11A
11B
12
13
14
15
16
17
18
19
22
23
26
II
A

STRETCHER IN CALENDERS FOR TUBULAR KNITTED FABRICS

RELATED APPLICATION

The present application is a continuation-in-part of PCT application No. PCT/IT95/00178, filed Nov. 7, 1995.

Subject of the present invention is a stretcher for tubular knitted fabrics, in particular a stretcher to be applied in calenders or other machines for the treatment of tubular fabrics.

As it is known, during the finishing operations of tubular knitted fabrics, stretchers are used to spread out and stretch the tubular element in order to enhance the finishing operations. Thus in calendering, which usually is the last finishing operation, it is necessary to use a stretcher to achieve a uniform vaporization and to adjust the width of the tubular element to the desired value.

Known stretchers or expanders are provided with means placed between the stretcher arms, such as for example pantograph devices or telescopic tubes. These stretchers are provided in two or more sizes corresponding to the different width of the tubular fabric. In these conditions there is the disadvantage that, in order to change a width range, it is necessary to replace the stretchers, so that the machine must be shut down for fitting the new stretcher in and the tubular fabric portions must be unstiched and restiched.

The present invention is applied to stretchers of the prior art in order to improve them; in particular, reference is made to the European Patent No. 0267880 in the name of the owner of the present invention. This patent relates to a stretcher for tubular knitted fabrics comprising two stretcher arms horizontally moving in opposite directions, each arm provided with pulleys, whereby at least one of them is in contact with a drive wheel for carrying the tubular fabric and a support device integral with a support for the drive wheel which bears a shaped ring idle on each stretcher arm and in contact with the drive wheel, thus making the support integral with the stretcher arm.

The main object and technical problem of the present invention is to provide a stretcher in calenders for tubular knitted fabrics wherein the drive homogeneity of the carrying of the fabric, the centering of the stretcher arm and the adjustment of the work-angles are improved, and the stretcher is sturdy enough to have a practically inflexible bar on which the arms run with a high drive easiness for the motion of the stretcher arms.

The features, the advantages and the solution of the above mentioned technical problem of the invention will become apparent from the following detailed description of a preferred but not exclusive embodiment of the present stretcher, shown for a merely illustrative and not limiting purpose in the attached drawings wherein.

Figure 1:
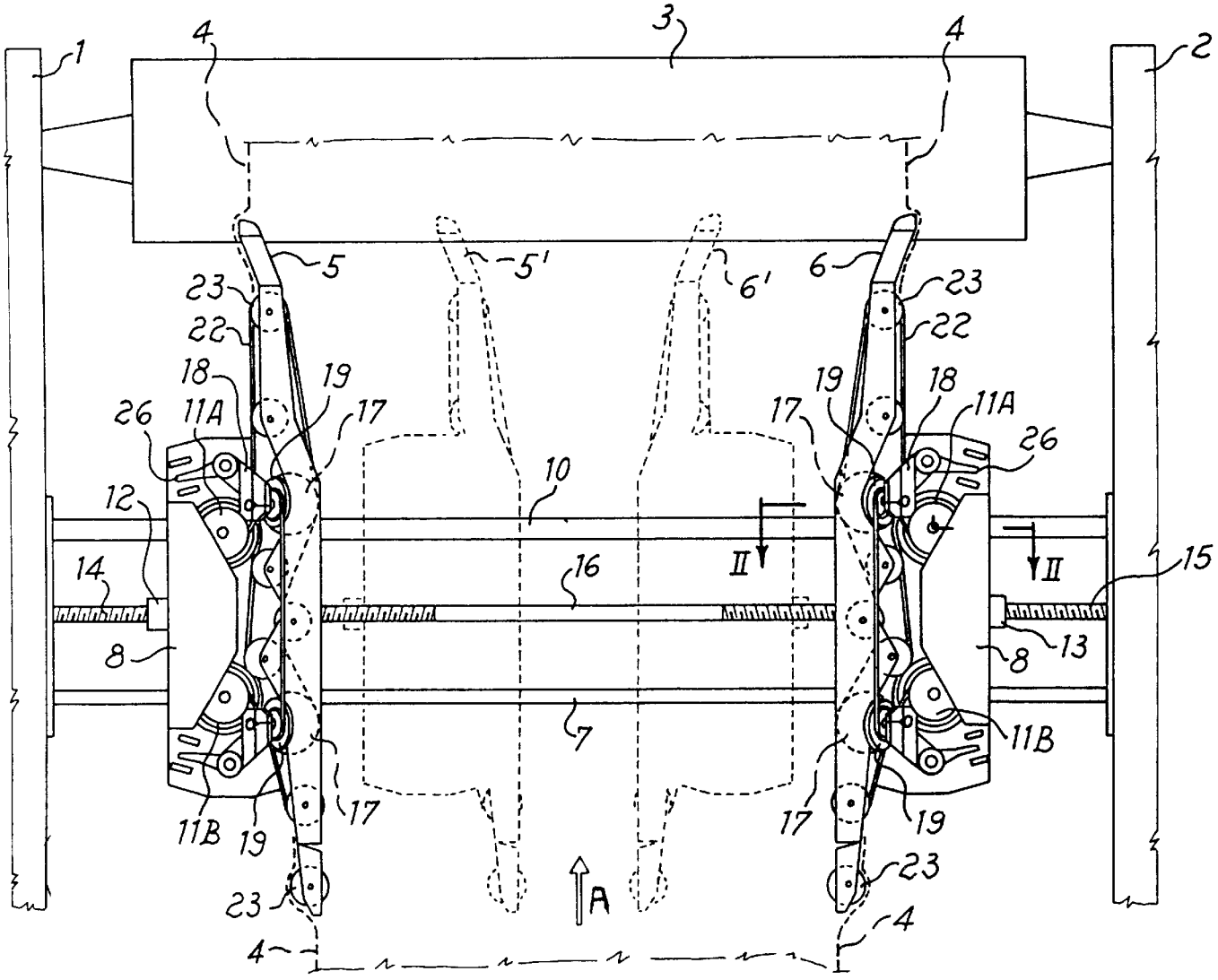
FIG. 1 is a front view of the stretcher.

Referring to the figures, the aforesaid calender consists of stands 1 and 2 containing the calender control and drive mechanisms not shown in the figure. These stands support the known vaporizer 3 wherein the tubular fabric 4 is introduced after having been passed through the stretcher according to the present invention.

The stretcher consists of stretcher arms 5 and 6 which are supported by support devices described afterwards. A guide bar 7 fastened to stands 1 and 2 bears the two supports 8 relevant to each arm 5, 6 and supports 8 bear a bevel gear set 9 which is driven by a grooved bar 10 and drives the upper drive wheels 11A.

The sole guide bar 7, having an appropriate size, is useful for giving a better strength to the stretcher so that the bar is practically inflexible.

Threaded bushings 12 and 13 are integral with supports 8, said bushings being engaged with opposite handed threads 14 and 15 respectively which are provided on actuating shaft 16. Bar 10 and shaft 16 are driven by known means contained in stands 1 and 2 and not shown in the figure. When shaft 16 rotates, the two opposite handed threads 14 and 15 move in opposite directions bushings 12 and 13, supports 8 and therefore stretcher arms 5 and 6.

Upper drive wheels 11A are connected to the similar lower wheels 11B by means not shown in the figure, such as chains, toothed belts or similar.

Figure 2:
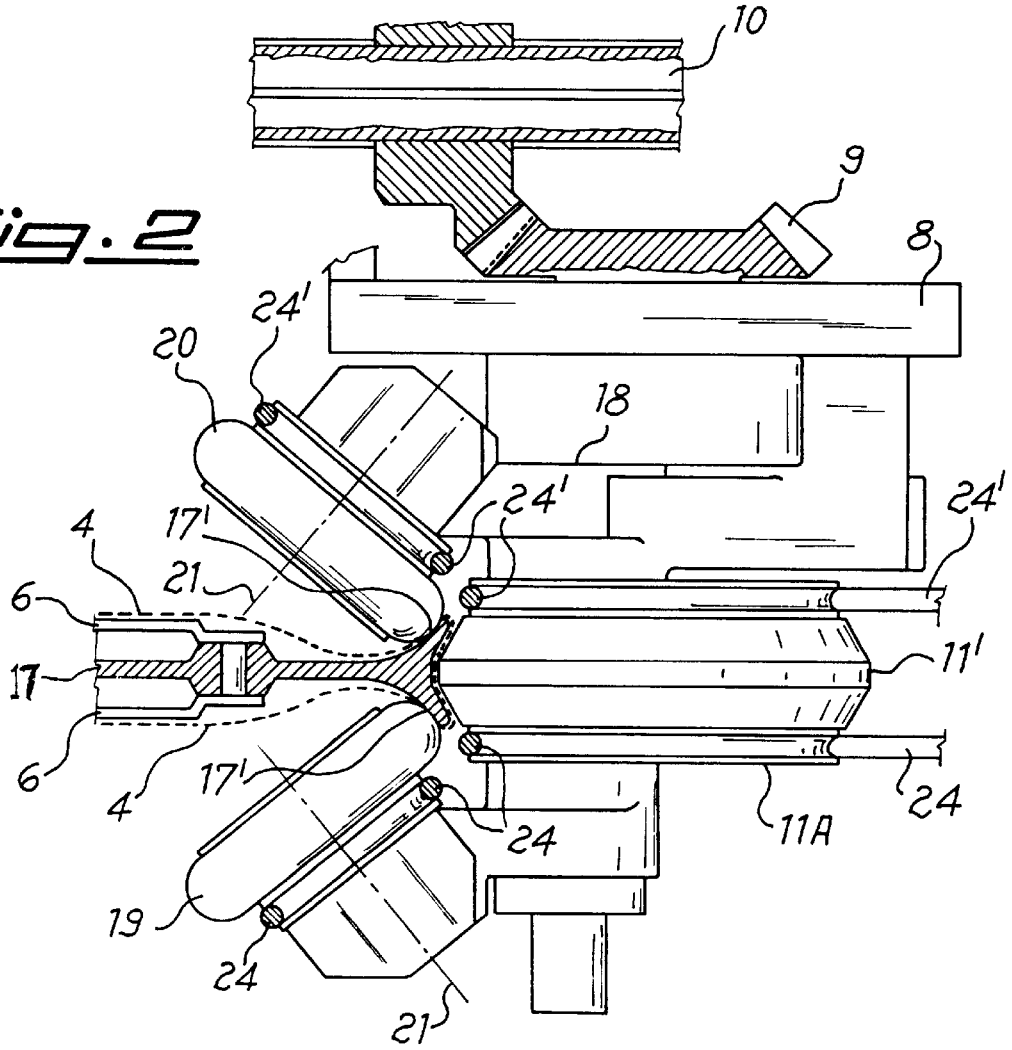
FIG. 2 is an enlarged view of a partial horizontal section of the stretcher along line II—II of FIG. 1.

As it is clearly shown in FIGS. 1 and 2, stretcher arms 5 and 6 bear idle rings 17, suitably shaped, which are in contact with the convex portion 11' of drive wheels 11A and 11B. These wheels bear mountings 18 which support the aforesaid support devices consisting of pairs of support rolls 19 and 20 with angled axle 21. Rolls 19 and 20 support arms 5 and 6 by engaging their peripheral portion with the circular profile 17' of rings 17, thus aligning them in parallel. This parallel alignment is kept thanks to the sets of rolls 19 and 20 with angled axle which are two for each arm 5 and 6, whereby each set is engaged with drive wheels 11A and 11B and placed on both sides of actuating shaft 16. Tubular fabric 4 is carried by means of belts 22 wound on a line of pulleys 23 which are idle on arms 5 and 6, and along the shaped surfaces of drive wheels 11A and 11B and of rings 17.

Figure 3:
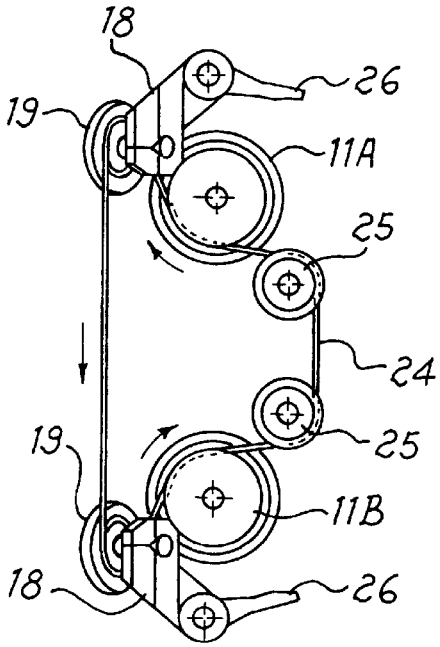
FIG. 3 is a view of a detail of the stretcher.

According to the main feature of the present invention, as can be clearly seen in FIGS. 2 and 3, both support rolls 19 are motor-driven because they are connected together by an elastic belt 24 which is wound on drive wheels 11A and 11B and on idle pulleys 25.

Similarly, support rolls 20 are motor-driven because they are connected to drive wheels 11A and 11B by means of an elastic belt 24'.

The motorization advantageously improves the carrying of the fabric. Therefore, the convexity 11' of wheels 11A and 11B carries out a better centering of arms 5 and 6 and improves the working-angles thereof.

In particular, mountings 18 consist of fork brackets 26 for the adjustment of the working-angles of arms 5 and 6.

The velocity of the rolls 19, 20 must be carefully choosen having regard to the velocity of the driving wheel 11A or 11B on each support, so that the device works properly and the fabric does not break.

Operation is as follows: tubular fabric 4, which usually consists of several tubular pieces knitted together, is introduced from the bottom, as it is shown in FIGS. 1 and 2, between rolls 19, 20 and ring 17 and between ring 17 and wheels 11A and 11B of each arm, so it is carried to the top in the direction of arrow A by rotating drive wheels 11A and 11B engaged with rings 17 and pulleys 23 mounted on arms 5 and 6, which are kept in position and are supported by the aforesaid sets of rolls 19 and 20 with angled axle 21. In order to increase the tubular width, shaft 16 is rotated by driving means not shown in the figure, so that threads 14 and 15 move arms 5 and 6 in the settled position, corresponding to the desired tubular width. The minimum width corresponds to the position of arms 5' and 6' shown with dotted lines in FIG. 1.

When a greater width of the tubular fabric is desired, shaft 16 is rotated in the opposite direction so that arms 5 and 6 move away from each other up to reach the maximum distance as shown with full lines in FIG. 1.

As it is apparent, the stretcher can take any position from a minimum to a maximum distance without changing the stretcher, i.e. without shutting the machine down and therefore without removing the tubular fabric from the stretcher.

Furthermore, as described above, thanks to this invention the carrying of the fabric, the centering of the stretcher arms, the adjustment of the working-angles and the strength of the stretcher are improved, the bar on which the arms run is practically inflexible and the stretcher is easy to control.

Practical or application-oriented variations can be made to the embodiment details of this invention without exceeding the scope thereof, as claimed below.

What is claimed is:

1. Stretcher in calendared tubular knitted fabrics comprising:

two substantially vertical stretcher arms (5, 6) positioned at working angles and being horizontally movable in opposite directions by an actuating shaft (16) and having at least one rotating drive wheel (11A, 11B);

each arm provided with pulleys (23) connected to a belt (22) for carrying the tubular fabric (4) and two support devices;

each support device comprising a pair of support rolls (19, 20) with circumferential external surfaces and angled axes (21);

said two support rolls (19, 20) being provided on both sides of the actuating shaft (16) which moves said pair of the two stretcher arms (5, 6) horizontally;

a ring (17) idle on each stretcher arm (5, 6) and in contact with said rotating drive wheel (11A, 11B), the circumferential external surfaces of the support rolls (19, 20) engaging with the surfaces of the ring (17), the tubular fabric being carried between said circumferential surfaces of said support rolls (19, 20) and the surfaces of said rings (17), both support rolls (19, 20) on each arm (5, 6) being motor-driven at least by said at least one rotating drive wheel (11A), and means for the adjustment of the working angles of the arms.

2. Stretcher according to claim 1, comprising a drive belt (24) connecting said support rolls (19) to the drive wheels (11A, 11B) for rotating saj support rolls (19), and a second drive belt (24') connecting said support rolls (20) to said drive wheels (11A, 11B) for rotating said support rolls (20).

3. Stretcher according to claim 1, comprising mountings (18) for support rolls 19, 20) consisting of fork brackets (26) for the adjustment the working-angles of the arms (5 and 6).

4. Stretcher according to claim 1, comprising a sole crossbar (7) bearing the two stretcher arms (5, 6) for movement along said crossbar (7).

5. Stretcher according to claim 1, characterized in that said rolls (19, 20) and said rings (17) have shaped external surfaces, the external surfaces of said rolls (19, 20) engaging with the shaped surfaces (17') of said rings (17).

* * * * *

UNITED STATES PATENT AND TRADEMARK OFFICE

CERTIFICATE OF CORRECTION

PATENT NO. : 5,867,879

DATED : February 9, 1999

INVENTOR : Giancarlo Ferraro et al.

It is certified that errors appear in the above-identified patent and that said Letters Patent is hereby corrected as shown below:

Claim 1, line 1, change "calendared" to --calender for--;

Claim 2, line 3, after "change "saj" to --said--;

Claim 3, line 3, after "adjustment" insert --of--.

Signed and Sealed this

First Day of June, 1999

*Attest:*

Q. TODD DICKINSON

*Attesting Officer*

*Acting Commissioner of Patents and Trademarks*